US005649579A

United States Patent [19]

Kokko et al.

[11] Patent Number: 5,649,579

[45] Date of Patent: Jul. 22, 1997

[54] APPARATUS FOR CLAMPING A CHIPPER KNIFE

[76] Inventors: Pekka Kokko, Pähkinätie, Hollola, Finland, 16710; Matti Kahilahti, Timontie 5, Hollola, Finland, 15880

[21] Appl. No.: 633,588

[22] Filed: Apr. 17, 1996

[30] Foreign Application Priority Data

Apr. 20, 1995 [FI] Finland ..... 951877

[51] Int. Cl.[6] ..... B27G 13/00; B27C 1/00

[52] U.S. Cl. ..... 144/176; 144/162.1; 144/218; 144/241; 241/92; 241/298; 407/49; 407/113

[58] Field of Search ..... 241/92, 296, 298; 407/47, 49, 113, 46, 112; 144/162.1, 176, 230, 241, 221

[56] References Cited

U.S. PATENT DOCUMENTS

| | | | |
|---|---|---|---|
| 3,981,337 | 9/1976 | Sundstrom | 144/241 |
| 4,155,384 | 5/1979 | Svensson | 144/176 |
| 4,694,995 | 9/1987 | Holmberg et al. | 241/92 |
| 4,997,018 | 3/1991 | Carpenter et al. | 144/241 |
| 5,444,904 | 8/1995 | Kokko | 29/402.08 |

FOREIGN PATENT DOCUMENTS

| | | | |
|---|---|---|---|
| 78412 | 4/1982 | Finland | B27L 11/00 |

*Primary Examiner*—W. Donald Bray
*Attorney, Agent, or Firm*—Chilton, Alix & Van Kirk

[57] ABSTRACT

The object of the invention is an apparatus for clamping a chipper knife (1) to a rotatable chipper disc (4) or drum so that the back surface (6) of the knife (1) is supported against a knife clamp (2) with a knife spacer (3), and that the knife clamp (2) and knife spacer (3) are movable relative to each other by means of the clamping element (5). The knife clamp (2) is provided with supporting surfaces (11, 12) which the back surface (6) of the knife (1) is adapted to lean against by at least two spaced-apart surfaces (11', 12'). The knife spacer element (3) includes a supporting surface (13) which is adapted to subject a front surface (14) of the knife (1) to a force acting between said supporting surfaces (11, 12) of the knife clamp (2) for bending the knife (1) between said supporting surfaces (11, 12) of the knife clamp (2) towards the knife clamp (2) so as to generate a compression stress in the free section of a front surface (16) of the knife (1).

20 Claims, 5 Drawing Sheets

APPARATUS FOR CLAMPING A CHIPPER KNIFE

The present invention relates to an apparatus for clamping a chipper knife to a rotatable chipper disc or drum by using a clamping element and a knife clamp and a knife spacer movable relative to each other for supporting a back surface of the knife against the knife clamp.

Chippers are used for making wood chips for example from tree trunks for the digestion of pulp or burning of wood. The prior art is described in the publication U.S. Pat. No. 4,155,384, which discloses a disc chipper provided with a disc and knives. The Finnish publication FI 78412 discloses a so-called turn knife and its clamping to a disc chipper.

During chipping, a chipping force is directed to the knife thus causing major local tensile stresses in the knife and the knife structure must therefore be given a substantial thickness in the direction of tensile stress. The chipper knives are wear parts and increasing the amount of knife material incurs an extra cost. In difficult conditions, for example when chipping frozen wood, the knives are subjected to extremely great loadings. This may lead to the breakage of a knife, which in turn adds to maintenance costs.

The object of this invention is to avoid deficiencies of the prior art and to introduce a chipper knife which, in terms of its thickness, can be made thinner than the knives of the prior art and which knife is nevertheless clearly more durable as far as breakage is concerned.

This object is achieved by an apparatus of the invention, the said apparatus being characterized in that the knife clamp is provided with supporting surfaces which the back surface of the knife is adapted to support against by at least two spaced-apart surfaces, and that the knife spacer includes a supporting surface which is adapted to subject a front surface of the knife to a force acting between said supporting surfaces of the knife clamp for bending the knife between said supporting surfaces of the knife clamp towards the knife clamp so as to generate a compression stress in the non-supported section of a front surface of the knife.

A specific feature in an apparatus of the invention is that the first support point in the back surface of the knife, counting from the knife edge, is located close to the knife edge, and that the free length of the front surface of the knife, i.e. the distance between the first support point of the front surface and the knife edge, is large compared to the distance between the first support point of the knife's back surface and the knife edge. Now, when a clamping force is directed to the knife at the first support point of the knife's front surface, which support point lies between the support points of the knife's back surface, the knife bends in such a manner that a compression stress is generated on the front surface side of the knife by the action of such bending. At the same time, said first support points, counting from the knife edge, on the front and back section of the knife, are vigorously pressed against the knife.

An apparatus of the invention is capable of creating the effect that the stresses caused by a chipping force are distributed over the long free section of the front surface and that the chipping force reduces the compression stress acting on the front surface of the knife but cannot create knife-damaging tensile stresses. Another essential feature is that the chipping force increases the supporting forces acting on the support points or surfaces of a knife. As a result of these factors, dangerous vibration of the knife is prevented and the contact of the first support points or surfaces on the front and back side of the knife is ensured, so as to prevent the access of wood material between the support points and the knife.

The invention will now be described in more detail with reference made to the accompanying drawings, in which.

Figure 1:
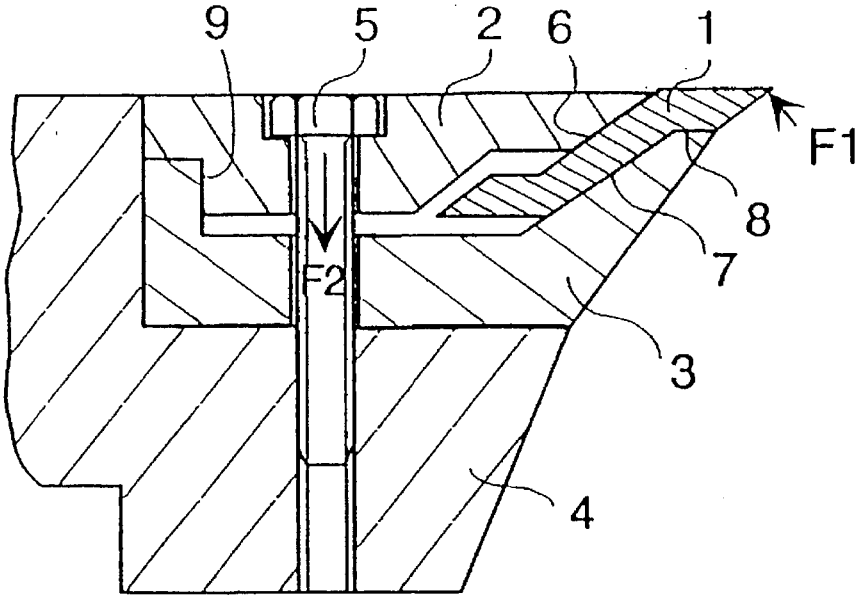
Fig. 1 (PRIOR ART)
FIG. 1 shows a prior art chipper knife with its clamping element.

FIG. 1 illustrates the clamping of a turnable knife to a disc chipper according to one prior art. A mildly z-shaped knife 1 is clamped by means of a clamping element 5 to a chipper disc 4 between knife clamp 2 and knife spacer 3.

A force F2 represents the clamping force of the clamping element 5 which draws the clamp 2 and spacer 3 toward each other. A force F1 represents the direction of a chipping force applied to the knife 1 during chipping, the force being slightly inclined in relation to the plane of the chipper disc. The knife 1 is immobilized by forces which result from the force F2 of the clamping element 5 and produce supporting forces applied to supporting surfaces 6, 7 and 8. The supporting surfaces 6, 7 and 8 are parallel to countering surfaces of knife clamp 2 and knife spacer 3. A vertical surface 9 of a protrusion at the other end of the knife clamp 2 transmits to the chipper disc 4 and to the knife spacer 3 a component of the chipping force F1, which component is parallel to the chipper disc 4.

Figure 2:
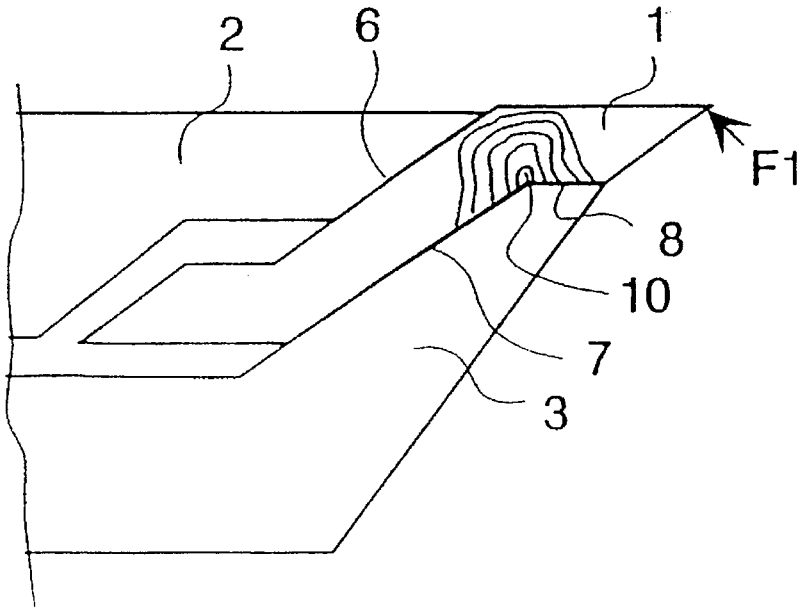
Fig. 2 (PRIOR ART)
FIG. 2 shows the stresses occurring in the knife of FIG. 1 during the course of operation.

FIG. 2 illustrates stresses caused by the chipping force F1 in the knife 1 when using a knife as shown in FIG. 1. The knife 1 is pressed by its supporting surfaces 6, 7 and 8 between the knife clamp 2 and the knife spacer 3. The chipping force F1 produces a major tensile stress at the point 10. The magnitude of chipping force F1 varies widely and it is particularly great when chipping a hard material, such as frozen wood, whereby the knife may be subject to vibration. The intensity of vibration may be such that the knife may get loose from its supporting surface 8 and break, usually at the point 10. In order to reduce the stress directed towards the cross-sectional area of the knife and to eliminate the knife vibration, the knife must be made thick in the direction of its cross section.

FIGS. 3–10 illustrate mechanisms for supporting a chipper knife based on the invention. The components corresponding to each other are designated with the same reference numbers as in FIGS. 1 and 2.

Figure 3:
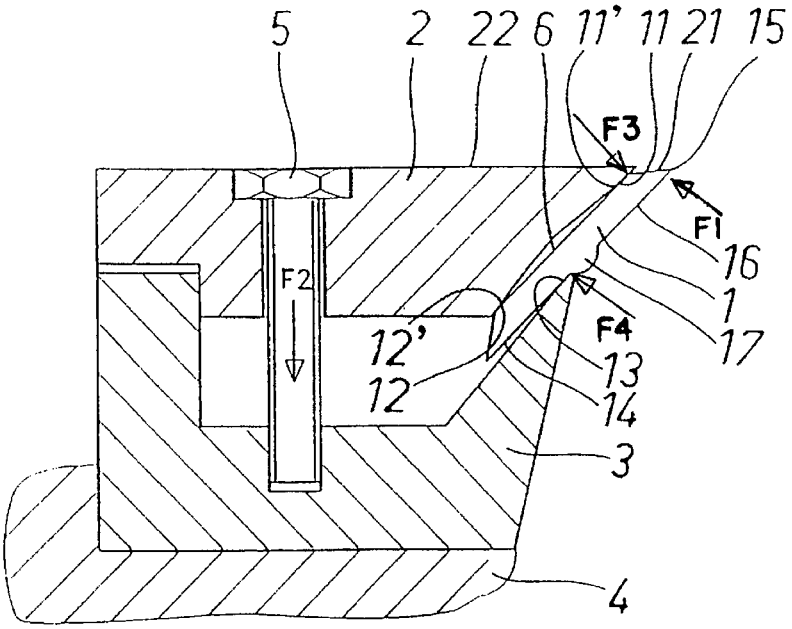
FIG. 3 shows a knife according to the first embodiment of the invention provided with a clamping element with the knife unclamped.
Figure 4:
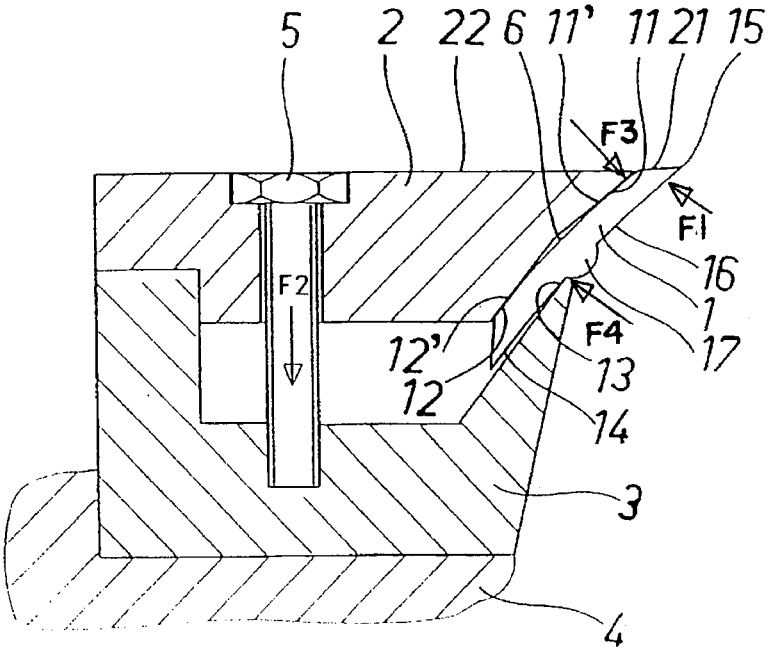
FIG. 4 shows a knife according to a first embodiment of the invention provided with a clamping element with the knife clamped.

The knife 1 shown in FIGS. 3 and 4 is designed as a turnable knife made of material having a substantially flat cross-section. The clamping elements for the knife 1 comprise, as described in reference to FIG. 1, a knife clamp 2 and a knife spacer 3 for clamping the knife 1 therebetween by means of clamping element 5. The knife clamp 2 is provided with supporting surfaces 11 and 12, which the back surface 6 of the knife 1 is adapted to support against by at least two spaced-apart surfaces 11', 12'. The surfaces 11', 12' are preferably placed in the opposite ends of the knife 1, whereby the knife 1 forms a bended element supported by the ends. The knife spacer 3 includes a supporting surface 13, which is adapted to apply to a front surface 14 of the knife 1 a force acting between the supporting surfaces 11, 12, of the knife clamp 2 for bending the knife 1 between said supporting surfaces 11, 12 of the knife clamp 2 towards the knife clamp 2 in such a manner that the free section of a front surface 16 is subjected to a compression stress. The free section may be considered as the unsupported portion of the front surface including the cutting tip 15, which is exposed to contact with the wood to be chipped. In FIG. 4, the back surface 6 of the knife 1 is then for most parts thereof compressed against or towards a trough-like groove formed by the supporting surfaces 11, 12 of the knife clamp 2. Thus, the front surface of the knife 1 is subjected to a compression stress. In FIG. 4, the trough-like groove formed by the supporting surfaces 11, 12 is in the knife clamp 2 but it is obvious that the groove can also be made in the knife 1 itself.

The free distance between the supporting surface 13 of the knife spacer 3 and a tip 15 of the knife 1 is adapted to be multiple compared to the distance measured in the direction of the front surface 16 of the knife 1 between the supporting surface 11 of the knife clamp 2 closest to the tip 15 of the knife 1 and the tip 15 of the knife 1. A torque of the chipping force F1 acting on the tip 15 of the knife 1 relative to the supporting surface 11 abutting against the knife back surface 6 and closest to the knife tip 15 becomes small as a result of the shortness of a torque arm. This torque is compensated for by means of a counter torque produced by means of a force F4 applied by the supporting surface 13 of the knife spacer 3 to the knife 1, said counter torque having thus a very long torque arm. As a result of such torque arm ratios, the chipping force on one hand reduces the compression stress existing on the front surface 16 of the knife 1 and, on the other hand, increases the supporting forces F3, F4 between the knife 1 and the supporting surfaces 11 and 13, which both actions contribute to maintaining the knife undamaged.

Adjacent to the supporting surface 13 of the knife spacer 3, the knife 1 is provided with a thickening 17 in the free front surface 16 of the knife 1. The thickening 17 is intended to prevent chips from colliding with the knife spacer 3 at the junction of the front surface 16 of the knife 1 and the knife spacer and, thus, from eroding the point in question. A slip surface 21 included in the knife 1 does not require any type of thickening provided that a top surface 22 included in the knife clamp 2 is arranged, as shown in FIG. 4, in such a manner that the logs possibly running along the slip surface 21 do not collide with a corner between the top surface 22 and the supporting surface 11.

Figure 5:
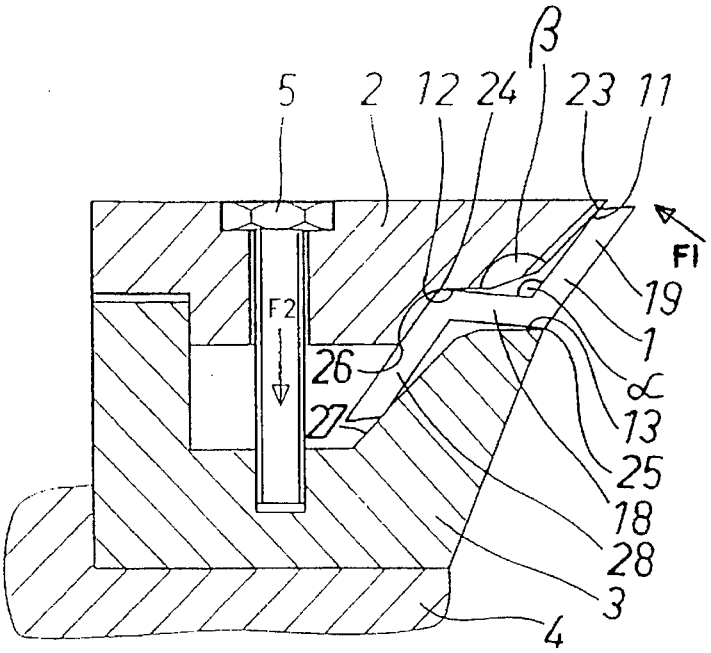
FIG. 5 shows a knife according to a second embodiment of the invention with the knife unclamped.
Figure 6:
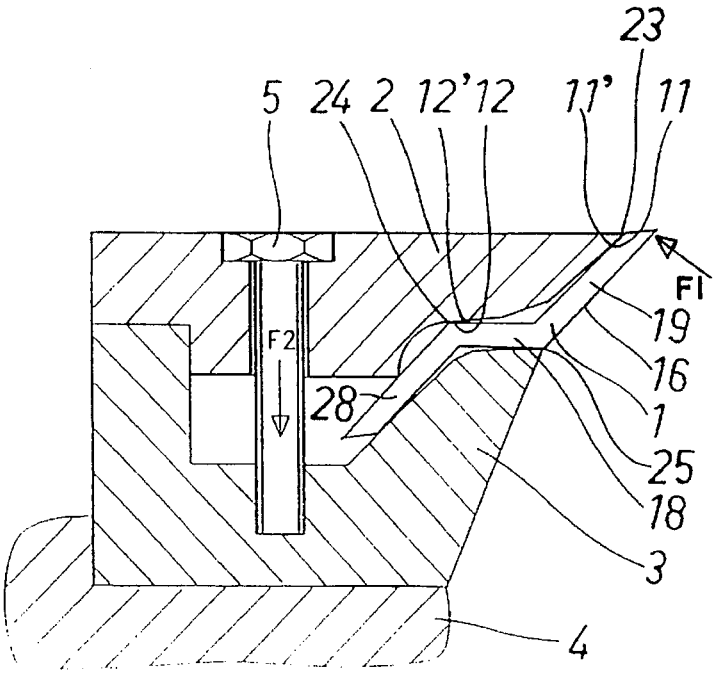
FIG. 6 shows a knife according to a second embodiment of the invention with the knife clamped.
Figure 7:
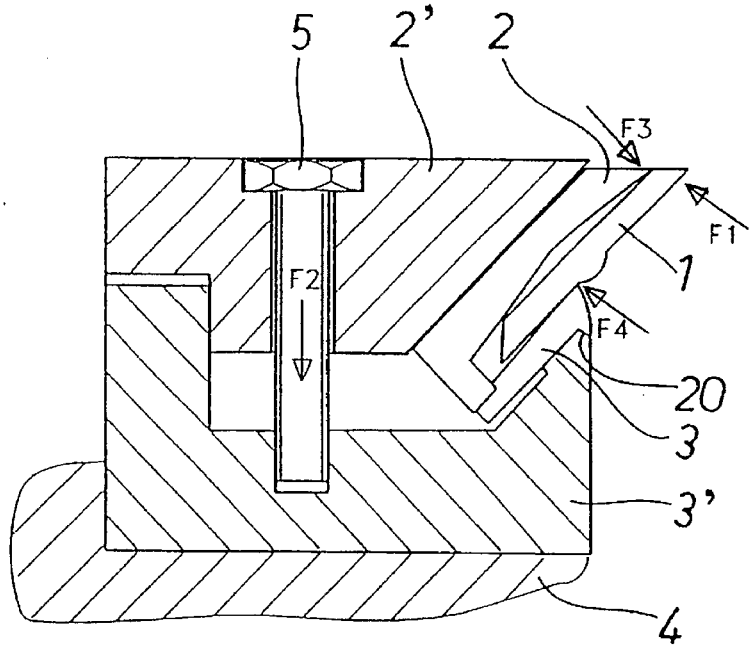
FIG. 7 shows the solution of FIG. 3 with the knife fitted in a mounting element with the knife unclamped.
Figure 8:
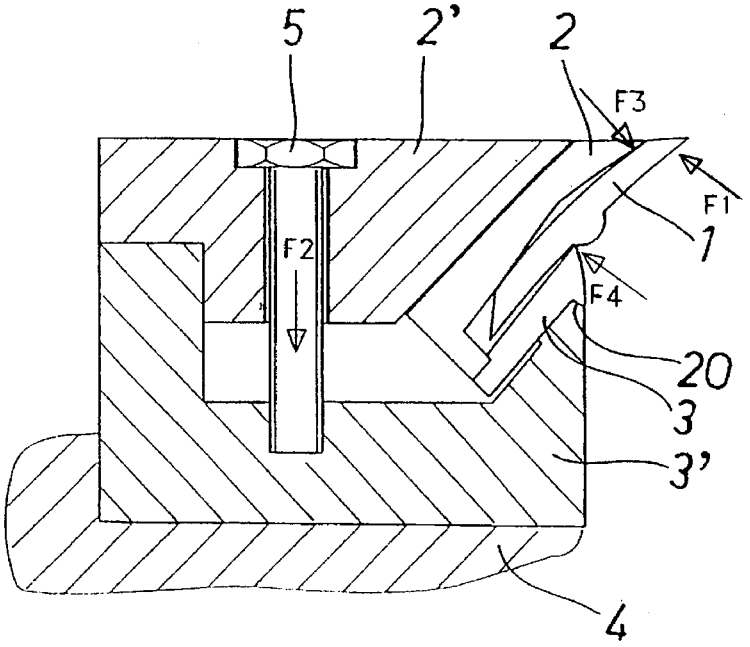
FIG. 8 shows the solution of FIG. 4 with the knife fitted in a mounting element with the knife clamped.
Figure 9:
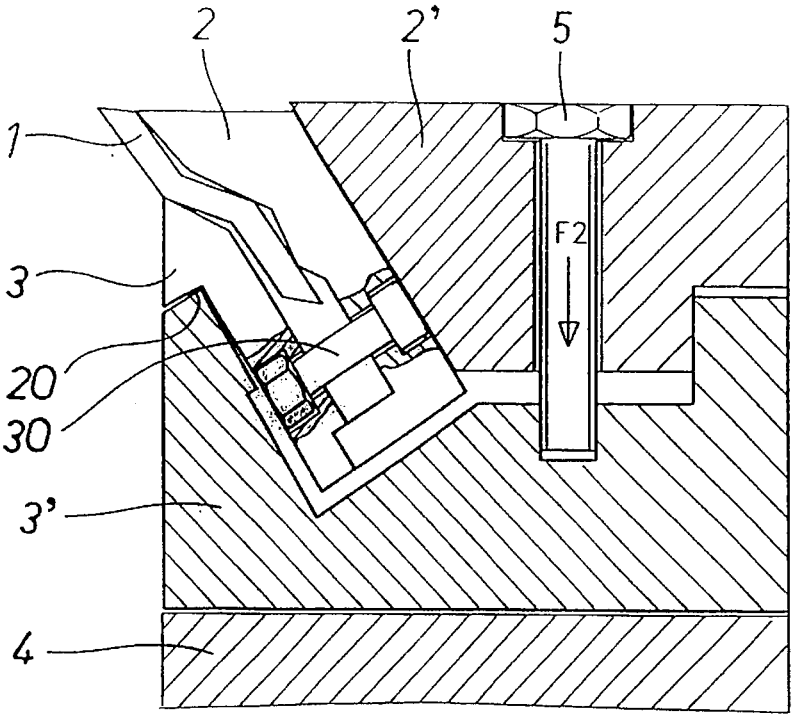
FIG. 9 shows the solution of FIG. 5 with the knife fitted in a mounting element with the knife unclamped.
Figure 10:
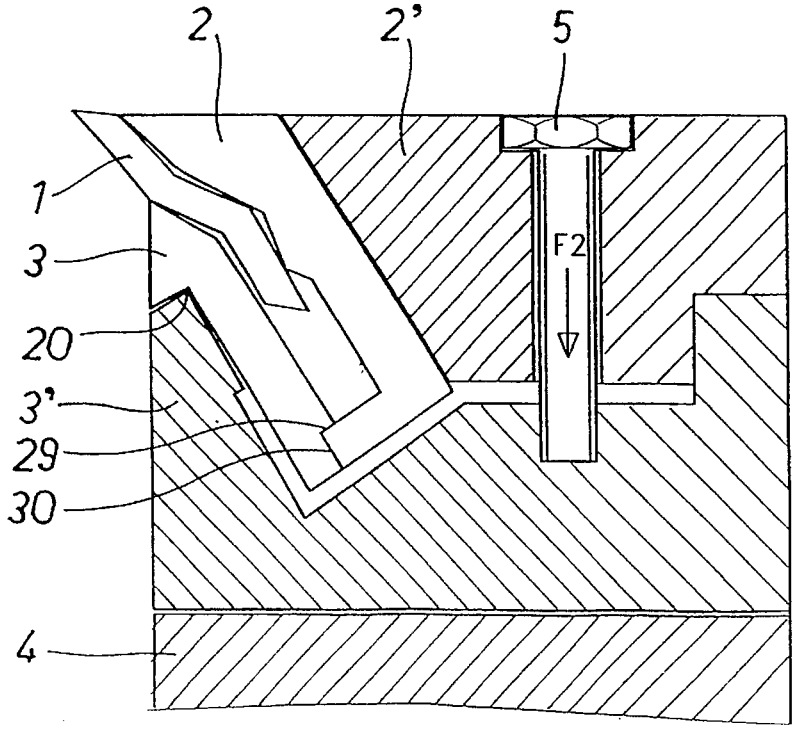
FIG. 10 shows the solution of FIG. 6 with the knife fitted in a mounting element with the knife clamped.

The knife 1 shown in FIGS. 5 and 6 is designed as a turnable knife made of a material with a mildly Z-shaped cross-section. Clamping elements for the knife 1 comprise, as described in reference to FIG. 1, a knife clamp 2 and a knife spacer 3 for clamping the knife 1 therebetween by means of a clamping element 5. It is because of the shape of the knife 1 that the shape of the knife clamp 2 and knife spacer 3 naturally differs to some extent from the solution shown in FIGS. 3 and 4. The front surface 16 of knife 1 consists of the surface of a Z-profile projecting section 19 extending away from a Z-profile middle section 18. The knife 1 having a Z-shaped cross-section is designed and clamped in such a manner that the clamping forces of the knife 1 straighten said knife 1, in other words, increase an angle $\alpha$ between the projection section 19, which makes up the actual knife 1, and the middle section 18.

The clamping solution for a Z-shaped knife shown in FIGS. 5 and 6 differs from that of a straight knife shown in FIGS. 3 and 4 mainly as follows.

The knife clamp 2 is provided with supporting surfaces 11, 12, which together form an angle $\beta$ which is larger than the angle $\alpha$ between the free projection section 19 and middle section 18 of the knife 1. Due to this, at the initial stage of clamping there are two line contacts at extremities 23, 24 of the flanks 18, 19 of the angle $\alpha$. As for its opposite surface, the knife 1 is initially clamped by means of a line contact between a supporting surface 13 of the knife spacer 3 and a corner 25 between the projecting section 19 and middle section 18 of the knife 1, said line contact developing, as the clamping progresses, into a more extensive surface contact as the angle $\alpha$ is approaching the angle $\beta$.

In order to achieve a reliable knife clamping, the knife clamp 2 is provided with an extra surface 26 for a second projecting section 28 in the knife 1 and the knife clamp 3 is provided with an extra surface 27, which are preferably configured differently than shown in FIG. 3 so that the extra surfaces 26, 27 bend said second protrusion in such a manner that the angle between a middle section 18 and said second protrusion 28 increases when the knife 1 is pressed to position. This is to assure that the knife is placed accurately enough in such a manner that the front surface 16 of the knife 1 is sufficiently far out to prevent the chips sliding therealong from colliding with the supporting surface 13 of the knife spacer 3 and, thus from eroding the same.

When the knife 1 is clamped, a supporting force between the knife clamp 2 and the knife 1 is at its peak at a location 23 in the knife 1. Moving away from said point 23, the contact of the knife 1 with the knife clamp 2 diminishes in such a manner that, near the bent portion, the apex of angle $\alpha$, there may be a small gap between the knife 1 and the knife clamp 2. Thus, to be absolutely precise, the bending of a knife occurring during the clamping of a knife does not bend the knife in an exactly planar fashion but, since the knife is made of a flexible material, the knife supporting surface bends into the shape of a slightly curved plane, including the location 23 which is, as noted above, in the tightest contact with its abutting surface of the knife clamp 2.

As a result of the above, rapidly changing chipping force F1 does not cause dangerous vibration of the knife or disengagement of the knife contact from the surface of the knife clamp at point 23. The stress condition of the knife caused by pretensioning is such that it compensates for the stresses caused by the chipping force F1 on the surface 16 and the knife has a low maximum stress value. For the above reasons it is possible to make a knife of the invention substantially thinner and still to achieve, as far as the knife breakage is concerned, a clearly improved reliability over the prior art solutions.

Thus, a knife of the invention will be cheaper in price than the prior art knives and the maintenance costs of knives (chippers) are reduced with fewer knife breakages.

FIGS. 7–10 illustrate yet another preferred embodiment of the invention which is configured so that the knife clamp comprises a body element 2' and a knife clamp 2, that the knife spacer comprises a body element 3' and a knife spacer 3, and that the knife clamp 2 and the knife spacer 3 as well as a knife 1 fitted therebetween are designed as a mounting element, which comprises an integral unit and is adapted to be fitted between the knife clamp body element 2' and the knife spacer body element 3'. When using a mounting element, it is possible to carry out in a simple manner the machining of precision-demanding surfaces included in the knife clamp 2 and the knife spacer 3 and coming against the knife 1. The surfaces between the mounting element and the body element 2' as well as the mounting element and the body element 3' are preferably straight flat surfaces.

The mounting element is provided with at least one guide surface 20 for bringing the mounting element in a controlled manner between the knife clamp body element 2' and the knife spacer body element 3' and for applying a compression force to the mounting element through the body elements 2' and 3'. Thus, a mounting element assembled into an integral unit outside the chipper by means of screws 30 in a per se known manner (FIG. 9) can be fitted in position quickly and accurately, whereafter clamping of the element and bending of a knife in the element are carried out by means of a clamping element 5.

The knife clamp 2 and the knife spacer 3 of the mounting element are provided with mutually guiding surfaces 29 and 30, said surfaces guiding the knife spacer 3 and the knife clamp 2 relative to each other in such a manner that, by pressing the knife spacer 3 and knife clamp 2 of the mounting element between the flat surfaces in the knife spacer and knife clamp body elements 3' and 2', the supporting surfaces included in the knife clamp 2 and knife spacer 3 of the mounting element and abutting against the knife produce a force required for clamping the knife and a bending stress to the knife.

We claim:

1. An apparatus for clamping a wood chipper knife (1) having front (14) and back (16) surfaces and a cutting tip (15) to a rotatable chipper disc (4) or drum, comprising:

a knife spacer (3) for mounting on the disc or drum and for receiving said chipper knife so as to support the front surface of said chipper knife;

a knife clamp (2) movable relative to the knife spacer, for engaging the knife spacer and supporting the back surface of the chipper knife;

a clamping element (5) movable relative to the knife spacer and the knife clamp, for drawing the knife clamp and knife spacer toward each other and thereby clamping the knife therebetween such that an unsupported portion of the front surface including the cutting tip is exposed to contact the wood to be chipped;

wherein the knife clamp (2) is provided with supporting surfaces (11,12) against which the back surface (6) of the knife (1) is supported by at least two spaced-apart surfaces (11', 12'), and the knife spacer (3) includes a supporting surface (13) which is adapted to subject the front surface (14) of the knife (1) to a force acting between said supporting surfaces (11, 12) of the knife clamp (2) for bending the knife (1) between said supporting surfaces (11, 12) of the knife clamp (2) towards the knife clamp (2) so as to generate a compression stress in the unsupported portion of the front surface (16) of the knife (1).

2. An apparatus as set forth in claim 1, wherein the unsupported portion defines a free distance between the supporting surface (13) of the knife spacer (3) and the tip (15) of the knife (1), which is a multiple compared to the distance measured in the direction of the front surface (16) of the knife (1) between the supporting surface (11) of the knife clamp (2) closest to the tip (15) of the knife (1) and the tip (15) of the knife (1).

3. An apparatus as set forth in claim 1 wherein the knife (1) is designed as a turnable knife made of a material having a substantially flat cross-section.

4. An apparatus as set forth in claim 1 wherein the knife (1) is designed as a turnable knife made of a material having a mildly Z-shaped cross-section.

5. An apparatus as set forth in claim 4, wherein the front surface (16) of the knife (1) consists of the surface of a Z-profile projecting section (19) extending away from a Z-profile middle section (18).

6. An apparatus as set forth in claim 4 wherein the knife (1) having a Z-shaped cross-section is designed and clamped in such a manner that the clamping forces of the knife (1) straighten said knife (1) by increasing an angle of which exists between a first projecting section (19), which includes the unsupported front portion of the knife (1) and a middle section 18.

7. An apparatus as set forth in claim 4, wherein the knife (1) having a Z-shaped cross-section is designed and clamped in such a manner that the clamping forces of the knife (1) are adapted through the intermediation of supporting surfaces (26 and 27) to increase an angle between the knife middle section (18) and a projecting section (28) remaining inside the apparatus.

8. An apparatus as set forth in claim 1 wherein the knife (1) is provided with a thickening (17) on the unsupported front surface (16) adjacent to the supporting surface (13) of the knife spacer (3).

9. An apparatus as set forth in claim 1, wherein the knife clamp comprises a body element (2') and a knife clamp element (2), the knife spacer comprises a body element (3') and a knife spacer element (3), and the knife clamp element (2) and the knife spacer element (3) as well as the knife (1) fitted therebetween are designed as a mounting unit adapted to be fitted between the knife clamp body element (2') and the knife spacer body element (3').

10. An apparatus as set forth in claim 9, wherein the mounting unit is provided with at least one guide surface (20) for bringing the mounting unit in a controlled manner between the knife clamp body element (2') and the knife spacer body element (3') and for applying a compression force to the mounting unit through the drawing together of the body elements (2' and 3') by said clamping element.

11. An apparatus as set forth in claim 9 wherein the knife clamp element (2) and the knife spacer element (3) of the mounting unit are provided with mutually guiding surfaces (29 and 30), said surfaces guiding the knife spacer element (3) and the knife clamp element (2) relative to each other in such a manner that, by pressing the knife spacer element (3) and knife clamp element (2) of the mounting unit between the flat surfaces of the knife spacer and knife clamp body elements (3' and 2'), the supporting surfaces in the knife clamp element (2) and knife spacer element (3) of the mounting unit, abutting against the knife, produce a force required for clamping the knife, and a bending stress to the knife.

12. An apparatus as set forth in claim 2, wherein the knife (1) is designed as a turnable knife made of material having a substantially flat cross-section.

13. An apparatus as set forth in claim 2, wherein the knife (1) is designed as a turnable knife made of a material having a mildly Z-shaped cross section.

14. An apparatus as set forth in claim 13, wherein the front surface (16) of the knife (1) consists of the surface of a Z-profile projecting section (19) extending away from a Z-profile middle section (18).

15. An apparatus as set forth in claim 13, wherein the knife (1) having a Z-shaped cross-section is designed and clamped in such a manner that the clamping forces of the knife (1) straighten said knife (1) by increasing an angle $\alpha$ which exists between a first projecting section (19), which includes the unsupported front portion of the knife (1) and a middle section 18.

16. An apparatus as set forth in claim 13, wherein the knife (1) having a Z-shaped cross-section is designed and clamped in such a manner that the clamping forces of the knife (1) are adapted through the intermediation of supporting surfaces (26 and 27) to increase an angle between the knife middle section (18) and a projecting section (28) remaining inside the apparatus.

17. An apparatus as set forth in claim 2, wherein the knife (1) is provided with a thickening (17) on the unsupported front surface (16) adjacent to the supporting surface (13) of the knife spacer (3).

18. An apparatus as set forth in claim 2, wherein the knife clamp comprises a body element (2') and a knife clamp element (2), the knife spacer comprises a body element (3') and a knife spacer element (3), and the knife clamp element (2) and the knife spacer element (3) as well as the knife (1) fitted therebetween are designed as a mounting unit adapted to be fitted between the knife clamp body element (2') and the knife spacer body element (3').

19. An apparatus as set forth in claim 18, wherein the mounting unit is provided with at least one guide surface (20) for bringing the mounting unit in a controlled manner between the knife clamp body element (2') and the knife spacer body element (3') and for applying a compression force to the mounting unit through the drawing together of the body elements (2' and 3') by said clamping element.

20. An apparatus as set forth in claim 18, wherein the knife clamp element (2) and the knife spacer element (3) of the mounting unit are provided with mutually guiding surfaces (29 and 30), said surfaces guiding the knife spacer element (3) and the knife clamp element (2) relative to each other in such a manner that, by pressing the knife spacer element (3) and knife clamp element (2) of the mounting unit between the flat surfaces of the knife spacer and knife clamp body elements (3' and 2'), the supporting surfaces in the knife clamp element (2) and knife spacer element (3) of the mounting unit, abutting against the knife, produce a force required for clamping the knife, and a bending stress to the knife.

* * * * *

UNITED STATES PATENT AND TRADEMARK OFFICE

CERTIFICATE OF CORRECTION

PATENT NO. : 5,649,579

DATED : July 22, 1997

INVENTOR(S) : Pekka Kokko et al

It is certified that error appears in the above-identified patent and that said Letters Patent is hereby corrected as shown below:

Column 6, line 11, change "of" to --α--.

Signed and Sealed this

Fifth Day of May, 1998

Bruce Lehman

*Attest:*

BRUCE LEHMAN

*Attesting Officer*

*Commissioner of Patents and Trademarks*